US009269326B2

(12) United States Patent
Lin

(10) Patent No.: US 9,269,326 B2
(45) Date of Patent: Feb. 23, 2016

(54) VOLTAGE COMPENSATION CIRCUIT AND OPERATION METHOD THEREOF

(71) Applicant: uPI Semiconductor Corp., Hsinchu County (TW)

(72) Inventor: Sheng-Chiun Lin, Hsinchu County (TW)

(73) Assignee: uPI Semiconductor Corp., Hsinchu County (TW)

( * ) Notice: Subject to any disclaimer, the term of this patent is extended or adjusted under 35 U.S.C. 154(b) by 379 days.

(21) Appl. No.: 13/784,837

(22) Filed: Mar. 5, 2013

(65) Prior Publication Data

US 2014/0028652 A1 Jan. 30, 2014

(30) Foreign Application Priority Data

Jul. 26, 2012 (TW) ..... 101127064 A

(51) Int. Cl.
*G09G 5/00* (2006.01)
*G09G 3/20* (2006.01)

(52) U.S. Cl.
CPC .. *G09G 5/00* (2013.01); *G09G 3/20* (2013.01); *G09G 2310/0267* (2013.01); *G09G 2310/08* (2013.01); *G09G 2320/041* (2013.01); *G09G 2330/028* (2013.01)

(58) Field of Classification Search
CPC ..... G09G 2320/0219; G09G 2310/06; G09G 3/3677
See application file for complete search history.

(56) References Cited

U.S. PATENT DOCUMENTS

2003/0006955 A1* 1/2003 Tsuchi ..... 345/92
2004/0041778 A1* 3/2004 Hiraki et al. ..... 345/100
2007/0008274 A1* 1/2007 Nakanishi et al. ..... 345/101
2007/0126667 A1* 6/2007 Nakamura et al. ..... 345/76
2008/0309608 A1* 12/2008 Shen et al. ..... 345/101
2010/0156961 A1 6/2010 Kim et al.
2011/0187690 A1 8/2011 Nakatsuka
2011/0205250 A1 8/2011 Yoo et al.
2011/0316640 A1 12/2011 Chang et al.

FOREIGN PATENT DOCUMENTS

TW 368612 9/1999
TW 200737109 10/2007
TW 201211970 3/2012

OTHER PUBLICATIONS

"Office Action of Taiwan Counterpart Application", issued on Jul. 25, 2014, p. 1-p. 4.

* cited by examiner

*Primary Examiner* — Kathy Wang-Hurst
*Assistant Examiner* — Matthew Yeung
(74) *Attorney, Agent, or Firm* — Jianq Chyun IP Office

(57) ABSTRACT

A voltage compensation circuit and an operation method thereof are provided. The voltage compensation circuit is suitable for a display device. The display device includes a direct-current voltage converter, a voltage level shifter, a panel, and a gate driving circuit. The voltage compensation circuit includes a voltage divider providing a divided voltage form a gate pulse signal, a comparing unit, a time counting unit and a processing unit. The comparing unit receives the divided voltage to provide at least one comparison result. The time counting unit provides a plurality of timing control signals at different time points according to the divided voltage. The processing unit provides a voltage reference signal to the direct-current voltage converter according to the plurality of timing control signals and the comparing result, and accordingly, the direct-current voltage converter adjusts an output voltage relating to the gate driving circuit.

7 Claims, 5 Drawing Sheets

VOLTAGE COMPENSATION CIRCUIT AND OPERATION METHOD THEREOF

CROSS-REFERENCE TO RELATED APPLICATION

This application claims the priority benefit of Taiwan application serial no. 101127064, filed on Jul. 26, 2012. The entirety of the above-mentioned patent application is hereby incorporated by reference herein and made a part of this specification.

TECHNICAL FIELD

The invention relates to a voltage compensation technique, and more particularly, to a voltage compensation circuit and operation method thereof for applying in a display device.

BACKGROUND

FIG. 1 is a functional block schematic diagram illustrating a display device with the conventional gate in panel (GIP) driving circuit technique. The display device 10 includes a timing controller TCON, a power management integrated circuit (PMIC), a voltage level shifter (LS), a gate in panel driving circuit 20, source drivers SD1, SD2, . . . , SDN and a panel 30, where the gate in panel driving circuit 20 is disposed on the panel 30. The timing controller TCOM controls the operation of the gate in panel driving circuit 20, and drives the pixel of every scan line individually. The gate driver of the gate in panel driving circuit 20 is formed by a thin film transistor (TFT), so as to replace the gate driver that is originally formed by a silicon semiconductor element. However, the gate driving circuit formed by the TFT element performs poorly at a low temperature.

Moreover, the properties of the gate in panel driving circuit 20 formed by the TFT element at room temperature may also change over time. For example, a gate pulse signal of scan lines on the upper half of the panel 30 is a complete pulse, but the gate pulse signal of scan lines on the bottom half of the panel 30 is not a complete pulse due to the capacitance effect or other factors, and this incomplete pulse would affect the display quality.

Currently, the solution for resolving the low-temperature circumstances described above from every major panel manufactures, is to dispose a thermistor $R_{NTC}$ and resistors R1, R2, wherein the serially connected resistors R1 and R2 are coupled between the operation voltage VDD and the ground, and the thermistor $R_{NTC}$ is connected to the both terminals of the resistor R2 in parallel. The thermistor $R_{NTC}$ is utilized to generate a temperature signal VT that is transmitted to the power management integrated circuit (PMIC), and thus the power management integrated circuit (PMIC) increases the high level on the gate voltage. Practically, every thermistor exists different degrees of tolerance, therefore, it may not be designed easily. Furthermore, the thermistor on the circuit board may be affected by other heat sources, thereby causing a misjudgement.

SUMMARY

Accordingly, in order to solve the problems mentioned above, the invention is directed to a voltage compensation circuit and an operation method thereof.

The invention provides a voltage compensation circuit for a display device. The display device includes a direct-current voltage converter, a voltage level shifter and a gate driving circuit disposed on a panel of the display device. The voltage compensation circuit includes a voltage divider, a comparing unit, a time counting unit and a processing unit. The voltage divider is coupled to the gate driving units, and provides a divided voltage. The comparing unit is coupled to the voltage divider, and receives the divided voltage and at least one predetermined reference voltage to provide at least one comparison result. The time counting unit is coupled to the voltage divider. The time counting unit provides a plurality of timing control signals at different time points according to the divided voltage. The processing unit is coupled to the comparing unit and the time counting unit. The processing unit provides a voltage reference signal to the direct-current voltage converter according to the plurality of timing control signals and the comparison result, and accordingly, the direct-current voltage converter adjusts an output voltage relating to the gate driving circuit.

In an embodiment of the invention, the predetermined reference voltage includes a first predetermined reference voltage and a second predetermined reference voltage.

In an embodiment of the invention, the comparing unit includes a first comparator and a second comparator. The first comparator has a first input terminal, a second input terminal and a first output terminal. The first input terminal receives the divided voltage, and the second input terminal receives the first predetermined reference voltage. The second comparator has a third input terminal, a fourth input terminal and a second output terminal. The third input terminal receives the second predetermined reference voltage, and the fourth input terminal receives the divided voltage.

In an embodiment of the invention, the first predetermined reference voltage is less than the second predetermined reference voltage.

In an embodiment of the invention, the processing unit includes a first D-type flip-flop and a second D-type flip-flop. The first D-type flip-flop is coupled to the first output terminal and the time counting unit. The first D-type flip-flop is configured to provide a first comparing signal. The second D-type flip-flop is coupled to the second output terminal and the time counting unit. The second D-type flip-flop is configured to provide a second comparing signal.

In an embodiment of the invention, the time counting unit respectively provides a first timing control signal and a second timing control signal among the plurality of timing control signals to the first D-type flip-flop and the second D-type flip-flop.

In an embodiment of the invention, the processing unit further includes a control logic circuit, an adder-subtracter, a latch circuit and a digital-to-analog converting circuit. The control logic circuit receives the first comparing signal and the second comparing signal, and accordingly, provides a first logic control signal and a second logic signal according to the first comparing signal and the second comparing signal. The adder-subtracter is coupled to the control logic circuit. The latch circuit is coupled to the adder-subtracter and the time counting unit to provide a digital signal. The digital-to-analog converting circuit is coupled to the latch circuit, and generates the voltage reference signal according to the digital signal. The adder-subtracter performs a calculation according to the first logic control signal, the second logic control signal and the digital signal.

In an embodiment of the invention, the latch circuit includes a plurality of D-type flip-flops.

In an embodiment of the invention, the latch circuit generates the digital signal according to a third timing control signal among the plurality of timing control signals and an output signal of the adder-subtracter.

From another point of view, the invention provides a voltage compensation method for a display device. The display device includes a direct-current voltage converter, a voltage level shifter and a gate driving circuit disposed on a panel of the display device. The voltage compensation method includes the following steps. At least one comparison result is provided according to a divided voltage from a gate pulse and at least one predetermined reference voltage. A plurality of timing control signals at different time points are provided according to the divided voltage. A voltage reference signal is provided to the direct-current voltage converter according to the plurality of timing control signals, and accordingly, an output voltage relating to the gate driving circuit is adjusted by the direct-current voltage converter.

In an embodiment of the invention, the step of providing a plurality of timing control signals at different time points according to the divided voltage includes: providing a first timing control signal and a second timing control signal, where the first timing control signal and the second timing control signal are configured to latch the comparison result.

In an embodiment of the invention, the step of providing a plurality of timing control signals at different time points according to the divided voltage further includes: providing a third timing control signal, where the third timing control signal is configured to latch a digital signal that is the voltage reference voltage before converting into an analog form.

According to the above descriptions, the invention is not for monitoring temperatures, it is utilized different time points to determine the voltage condition of the divided voltage. Therefore, the output voltage relating to the gate driving circuit may be adjusted, such that the degradation issue on the performance of TFT panels over time may be improved. On the other hand, the invention, without utilizing the thermistor in the display device, may reduce the development difficulty that is due to the thermistor, and cut down on the development time.

In order to make the features and advantages of the present invention more comprehensible, the present invention is further described in detail in the following with reference to the embodiments and the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
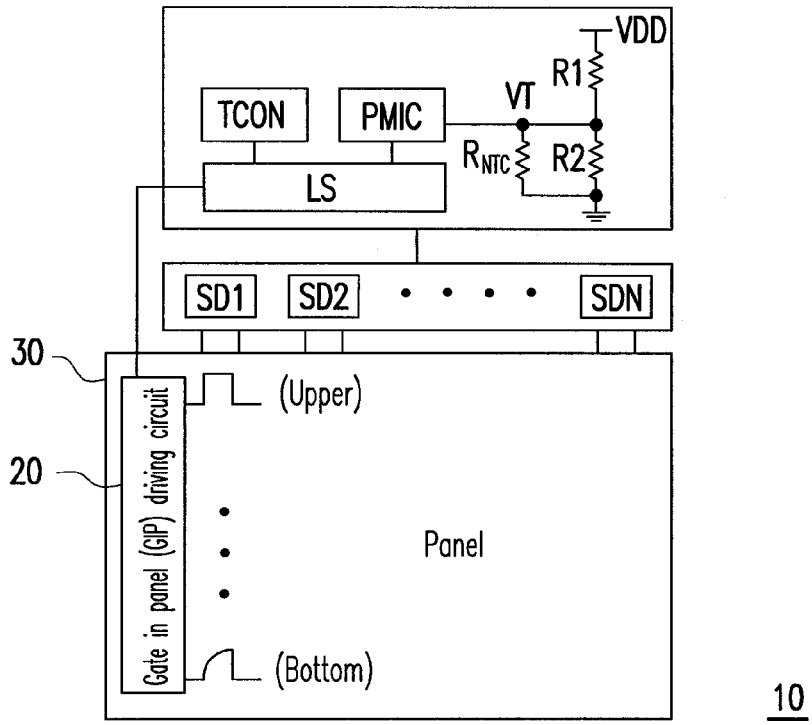
FIG. 1 (PRIOR ART)
FIG. 1 is a functional block schematic diagram illustrating a conventional display device.

Reference will now be made in detail to the present embodiments of the invention, examples of which are illustrated in the accompanying drawings. Wherever possible, the same reference numbers are used in the drawings and the description to refer to the same or like parts.

Figure 2:
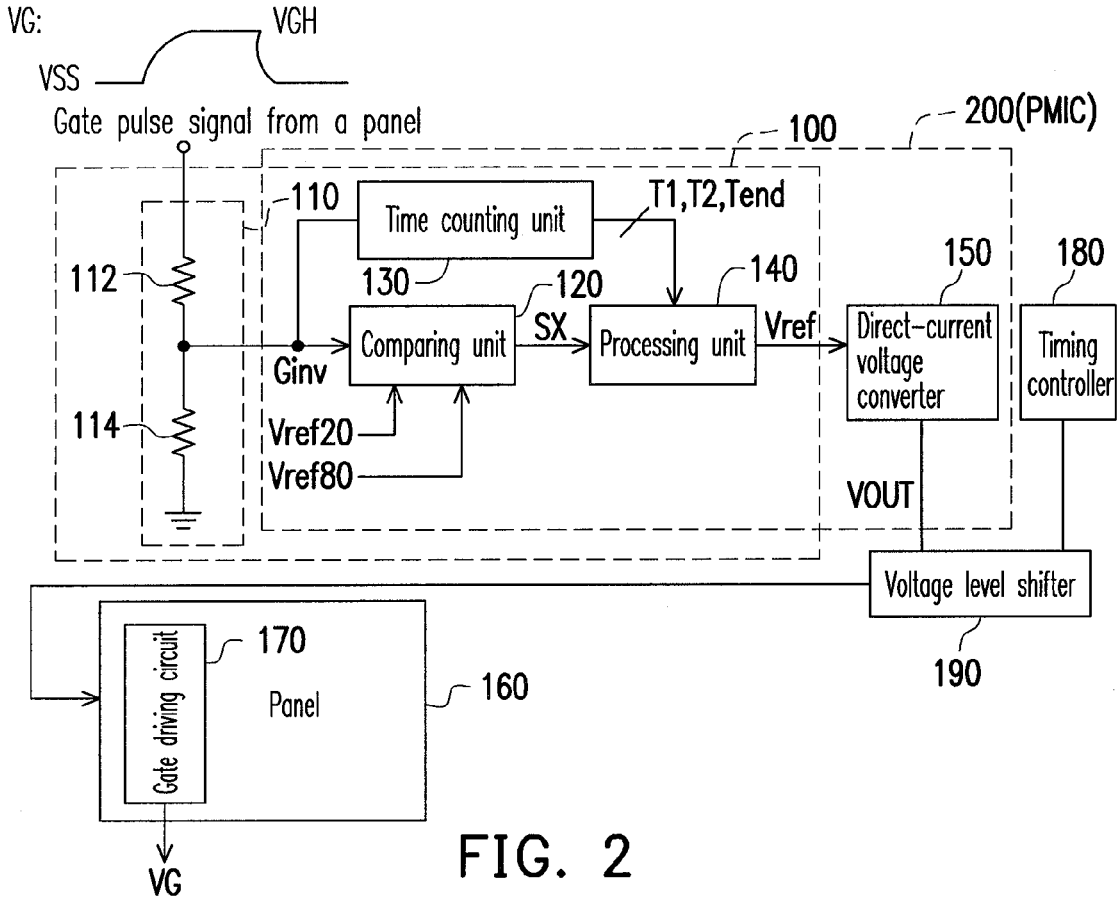
FIG. 2 is a structural schematic diagram illustrating a voltage compensation circuit according to an embodiment of the invention.

FIG. 2 is a structural schematic diagram illustrating a voltage compensation circuit according to an embodiment of the invention. Referring to FIG. 2, the voltage compensation circuit 100 is applicable in a display device. The display device includes a direct-current voltage converter 150, a timing controller (TCON) 180, a voltage level shifter 190 and a panel 160, wherein a gate driving circuit 170 is disposed on the panel 160 of the display device.

The voltage compensation circuit 100 includes a voltage divider 110, a comparing unit 120, a time counting unit 130 and a processing unit 140. In an embodiment, the comparing unit 120, the time counting unit 130, the processing unit 140 and the direct-current voltage converter 150 may be implemented in a part of a power management integrated circuit (PMIC) 200.

The voltage divider 110 is coupled to the power management integrated circuit 200. The voltage level shifter 190 is respectively coupled to the power management integrated circuit 200, the timing controller 180 and the gate driving circuit 170, wherein the voltage level shifter 190 receives a lower level of a logic control signal from the timing controller 180 and receives the voltage provided by the direct-current voltage converter 150 as an operation voltage, and the lower level of the logic control signal is undergone the voltage level shifting operation by the operation voltage, so as to output to the gate driving circuit 170.

The voltage divider 110 is coupled to the gate driving circuit 170, and configured to receive a gate pulse signal VG and provide a divided voltage Ginv from a gate pulse. A low level and a high level of the gate pulse signal VG are VSS and VGH, respectively, and an output voltage VOUT outputted by the direct-current voltage converter 150 may relate to the voltage level of the gate pulse signal VG, so that the embodiments of the invention may compensate the high level VGH of the gate pulse signal VG by adjusting the output voltage VOUT.

The comparing unit 120 is coupled to the voltage divider 110. The comparing unit 120 receives the divided voltage Ginv, a predetermined reference voltage Vref20 and/or a predetermined reference voltage Vref80, and is configured to provide a comparison result SX. The time counting unit 130 is coupled to the voltage divider 110. The time counting unit 130 provides a plurality of timing control signals T1, T2, Tend at different time points according to the voltage condition of the divided voltage Ginv at a rising edge/a falling edge. The following descriptions are described in detail with regard to the implementation of the predetermined reference voltage Vref20 and/or the predetermined reference voltage Vref80 and the timing control signals T1, T2, Tend.

The processing unit 140 is coupled to the comparing unit 120 and the time counting unit 130. The processing unit 140 provides a voltage reference signal Vref to the direct-current voltage converter 150 according to the plurality of timing control signals T1, T2, Tend and at least one comparison result SX. Under the circumstance that the gate pulse signal VG decays with time, the direct-current voltage converter 150 may adjust the output voltage VOUT of the gate driving circuit 170 according to the voltage reference signal Vref, thereby adjusting the voltage level of the gate pulse signal VG.

Figure 3:
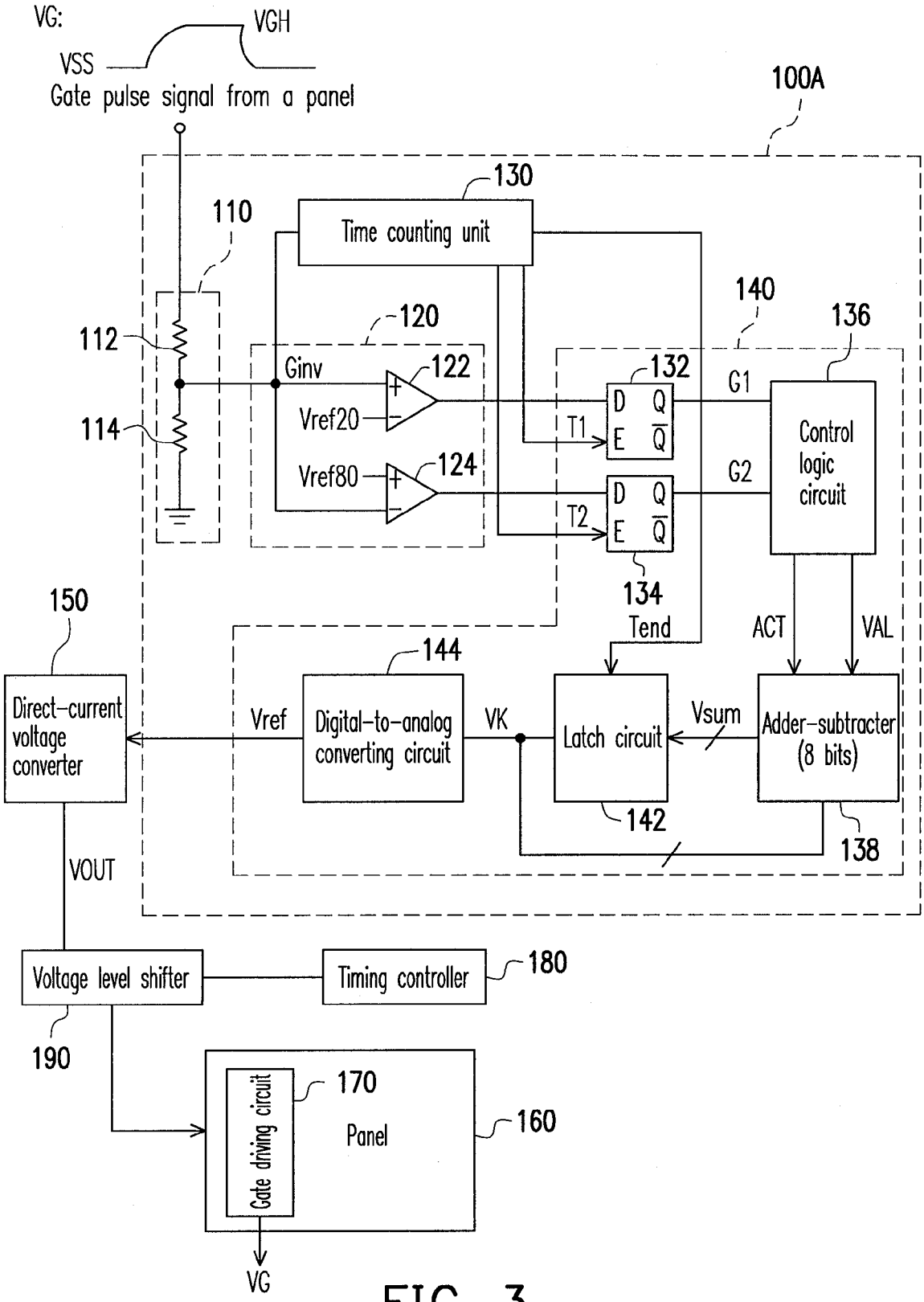
FIG. 3 is a circuit block diagram illustrating a voltage compensation circuit according to another embodiment of the invention.
Figure 4:
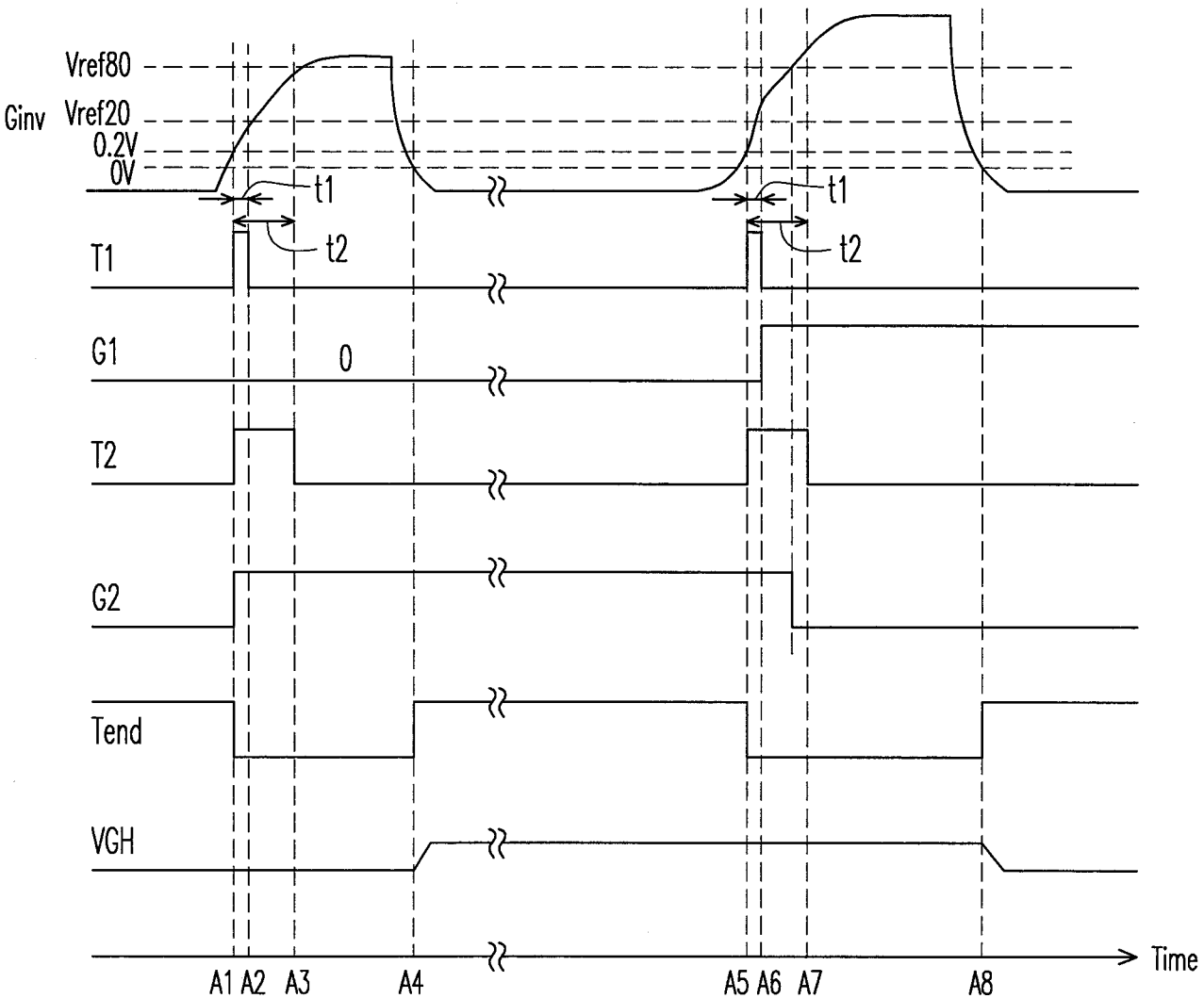
FIG. 4 is a timing diagram illustrating related signals of a voltage compensation circuit in FIG. 3.

Next, the voltage compensation circuit will be further described in the following description. FIG. 3 is a circuit block diagram illustrating a voltage compensation circuit according to another embodiment of the invention. FIG. 4 is a timing diagram illustrating a voltage compensation circuit 100A. Referring to FIG. 3 together with FIG. 4, the voltage compensation circuit 100A is based on the identical structure of the voltage compensation circuit 100 in FIG. 2. In the embodiment, the voltage divider 110 includes a resistor 112 and a resistor 114. The voltage divider 110 is coupled to the gate driving circuit 170 of the display device, such as pulling back the last gate pulse signal VG driving a scan line in the panel 160 to the voltage compensation circuit 100A. A divided voltage Ginv form a gate pulse is provided from where the resistor 112 and the resistor 114 are coupled.

Moreover, in the view of the theorem of voltage division, the resistor 112 and the resistor 114 has a certain proportional relation, such that the divided voltage Ginv and the gate pulse signal VG or the output voltage VOUT may also establish a certain proportional relation.

The comparing unit 120 includes a comparator 122 and a comparator 124. A positive input terminal of the comparator 122 receives the divided voltage Ginv, and a negative input terminal of the comparator 122 receives the predetermined reference voltage Vref20. A positive input terminal of the comparator 124 receives the predetermined reference voltage Vref80, and a negative input terminal of the comparator 124 receives the divided voltage Ginv.

In general, an initial reference value for the high level VGH of the gate pulse signal VG is usually about 25V~30V, while an initial reference value for the low level VSS is usually about −6V~7V. Here, in the embodiment, the predetermined reference voltage Vref20 may be arranged to about 20% of the initial reference value of the high level, while the predetermined reference voltage Vref80 may be arranged to 80% of the initial reference value of the high level, for example, the predetermined reference voltages Vref20, Vref80 are respectively designed to 0.3V and 1.5V. It should be noted that, the condition of the embodiments in the invention is that the predetermined reference voltage Vref20 has to be less than the predetermined reference voltage Vref80. In addition, the values of the predetermined reference voltages Vref20, Vref80 are not limited thereto.

When the divided voltage Ginv is at the rising edge and exceeded over 0V, the time counting unit 130 begins to count a time and provide a plurality of timing control signals T1, T2, Tend at different time points. For example, there are time points A1~A8 on the time axis. When the divided voltage Ginv is exceeded over 0.2V, a timing control signal T1 of a time width t1 (that is, between the time points A1~A2 or the time points A5~A6) is generated, and a timing control signal T2 of another time width t2 (that is, between the time points A1~A3 or the time points A5~A7) is generated, wherein t1<t2. Moreover, the time points of the timing control signals T1, T2 may be designed according to the system applications.

The processing unit 140 includes gated D-type flip-flops 132 and 134. An input terminal D of the gated D-type flip-flop 132 is coupled to the output terminal of the comparator 122, and an enabling terminal E of the gated D-type flip-flop 132 receives the timing control signal T1. An input terminal D of the gated D-type flip-flop 134 is coupled to the output terminal of the comparator 124, and an enabling terminal E of the gated D-type flip-flop 134 receives the timing control signal T2. Under the enablement of the timing control signal T1, the gated D-type flip-flop 132 stores the comparison result of the comparator 122 and provides a comparing signal G1. While under the enablement of the timing control signal T2, the gated D-type flip-flop 134 stores the comparison result of the comparator 124 and provides a comparing signal G2.

The processing unit 140 further includes a control logic circuit 136, an adder-subtracter 138, a latch circuit 142 and a digital-to-analog converting circuit 144. The adder-subtracter 138 is coupled to the control logic circuit 136. The latch circuit 142 is coupled to the adder-subtracter 138 and the time counting unit 130. The latch circuit 142 may include a plurality of D-type flip-flops, which are configured to latch an edge. The digital-to-analog converting circuit 144 is coupled to the latch circuit 142. The control logic circuit 136 receives the comparing signals G1, G2, and accordingly, provides a logic control signal ACT and a logic control signal VAL. The adder-subtracter 138 performs a calculation according to the logic control signals ACT, VAL and a digital signal VK, so as to generate an output signal Vsum.

The following Table 1 is a truth table for a variety of logic states. Please refer to Table 1 regarding the conversion procedures performed by the control logic circuit 136 and the adder-subtracter 138.

TABLE 1

| Event | | Input of the control logic circuit | | Output of the control logic circuit | | Operation of the adder-subtracter |
|---|---|---|---|---|---|---|
| T1 | T2 | G1 | G2 | ACT | VAL | Vref for VGH |
| Ginv < Vref20 | Ginv > Vref80 | 0 | 0 | 1 (subtraction) | 0 | Unchanged |
| Ginv < Vref20 | Ginv < Vref80 | 0 | 1 | 0 (addition) | 1 | Become 1 scale greater |
| Ginv > Vref20 | Ginv > Vref80 | 1 | 0 | 1 (subtraction) | 1 | Become 1 scale less |
| Ginv > Vref20 | Ginv < Vref80 | 1 | 1 | 0 (addition) | 1 | Become 1 scale greater |

The digital signal VK may be a value of 8 bits, which may perform the operation of addition or subtraction according to the logic value of the logic control signal ACT, such as, when the logic value of the ACT is "0" that indicates Vsum=VK+VAL, and when the logic value of the ACT is "1" that indicates Vsum=VK−VAL. When the divided voltage Ginv is at the falling edge and less than 0V (that is, at the time point A4 or A8), the time counting unit 130 stops to count times and sends the timing control signal Tend to the latch circuit 142. The latch circuit 142 stores the output signal Vsum and generates the digital signal VK.

Next, the digital-to-analog converting circuit 144 generates the voltage reference signal Vref in an analog form according to the digital signal VK, thereby outputting the voltage reference signal Vref to the direct-current voltage converter 150. Finally, the direct-current voltage converter 150 adjusts the output voltage VOUT according to the voltage reference signal Vref, thereby also adjusting the high level VGH of the gate pulse signal VG. In addition, the direct-current voltage converter 150 may be a combinational circuit of a booster or low dropout regulator (LDO) with a charge pump.

Based on the above descriptions, the embodiments of the invention are adopted to monitor the divided voltage, instead of monitoring the temperature, which may be utilized to improve the degradation issue on the performance of TFT panels over time. On the other hand, the embodiments of the invention provide the voltage reference signal according to the divided voltage, which are more feasible in practical. Since the thermistor is not utilized, the development difficulty that is due to the thermistor may be reduced, and the development time may be cut down.

Figure 5:
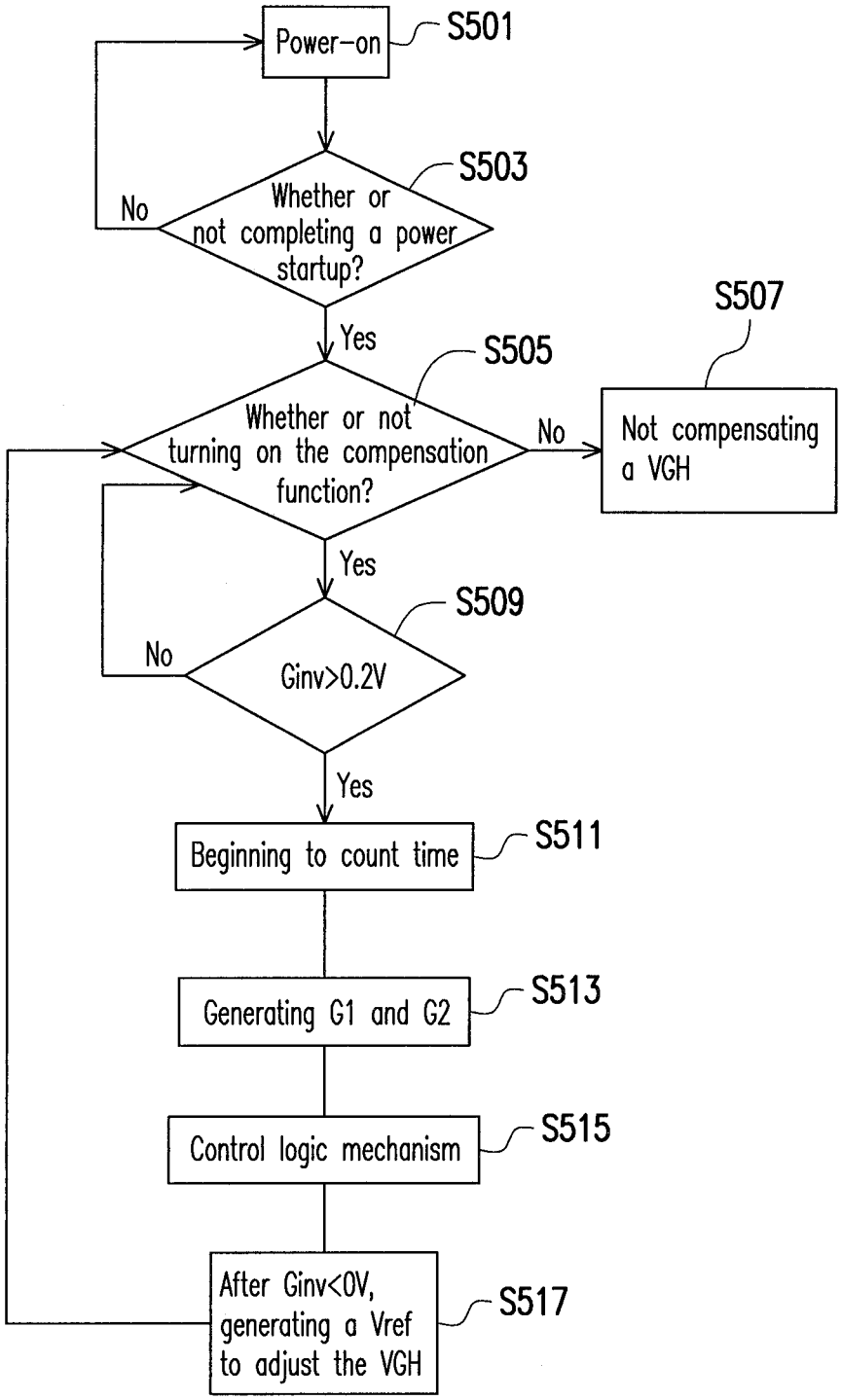
FIG. 5 is a flow chart illustrating a voltage compensation method according to an embodiment of the invention.

FIG. 5 is a flow chart illustrating a voltage compensation method according to an embodiment of the invention. Please refer to FIG. 5 together with FIG. 3.

As shown in step S501, it indicates that the display device is at the power-on condition. Next, as shown in step S503, whether or not completing the power start-up is determined. If the result is "No", return to step S501; if the result is "Yes", enter step S505.

In step S505, whether or not turning on the function of compensating the high level VGH is determined. If the result is "No", enter step S507 and the high level VGH is not compensated; if the result is "Yes", enter step S509.

In step S509, whether the divided voltage Ginv greater than 0.2V is determined, and if the result is "No", return to step S505; if the result is "Yes", enter step S511. It should be noted that, 0.2V is a threshold value for an embodiment, but the invention is not limited thereto.

In step S511, the time counting unit 130 begins to count time. Next, as shown in step S513, the comparing signals G1 and G2 are generated. Next, as shown in step S515, the control logic mechanism of the processing unit 140 begins to process the comparing signals G1 and G2. Next, as shown in step S517, after the divided voltage Ginv is less than 0V, the processing unit 140 generates the voltage reference signal Vref, so as to raise or lower the level value of the high level VGH. Then, return to step S505 again, and another workflow relating to step S505 through step S517 may be implemented.

Figure 6:
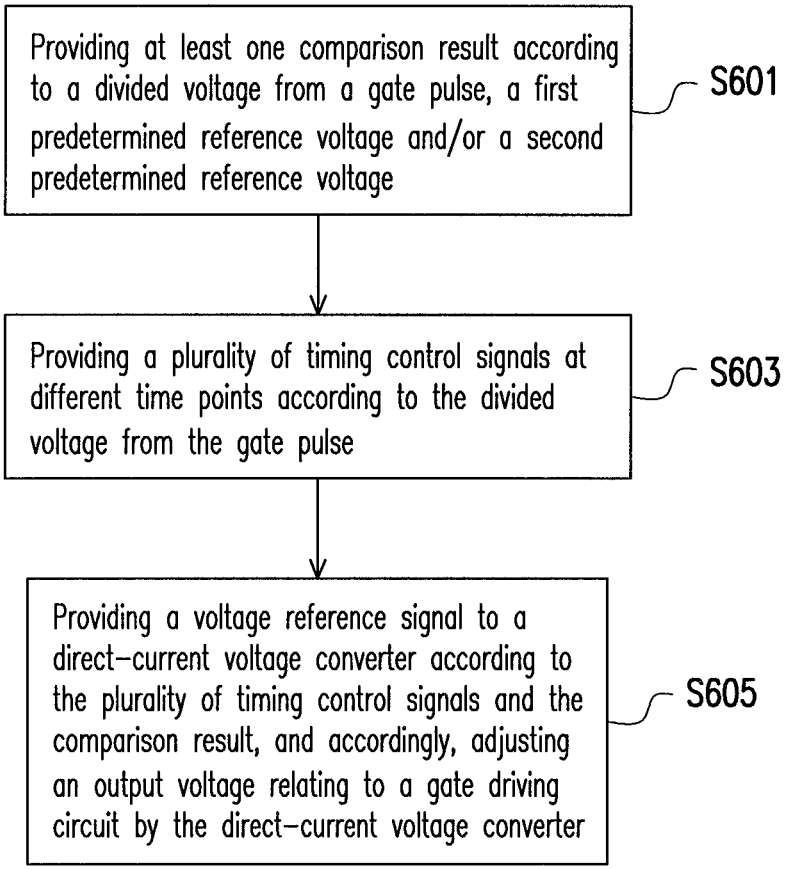
FIG. 6 is a flow chart illustrating a voltage compensation method according to an embodiment of the invention.

Based on the content disclosed by the aforementioned embodiments, a universal voltage compensation method may be summarized. To be specific, FIG. 6 is a flow chart illustrating a voltage compensation method according to an embodiment of the invention. For the purpose of illustration, please refer to FIG. 6 together with FIG. 2, the voltage compensation method of the embodiment may include the following steps.

As shown in step S601, the comparison result is provided according to the divided voltage Ginv and the predetermined reference voltage Vref20 and/or the predetermined reference voltage Vref80.

Next, as shown in step S603, a plurality of timing control signals T1, T2, Tend are provided at different time points according to the divided voltage Ginv.

Next, as shown in step S605, the voltage reference signal Vref is provided to the direct-current voltage converter 150 according to the plurality of timing control signals T1, T2, Tend and the comparison result, and accordingly, the direct-current voltage converter 150 adjusts the output voltage VOUT relating to the gate driving circuit 170.

According to the above descriptions, the invention is employed with different time points to determine the voltage condition of the divided voltage (the gate pulse signal) at a rising edge/a falling edge, therefore, the output voltage relating to the gate driving circuit may be adjusted. Furthermore, the invention is not monitoring the temperature, and is capable of improving the degradation issue on the performance of TFT panels over time. On the other hand, the invention, without utilizing the thermistor in the display device, may reduce the development difficulty that is due to the thermistor, and cut down on the development time.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage compensation circuit of a display device, the display device comprising a direct-current voltage converter, a voltage level shifter and a gate driving circuit disposed on a panel of the display device, the voltage compensation circuit comprising:

a voltage divider, coupled to the gate driving circuit and providing a divided voltage;

a comparing unit, coupled to the voltage divider and receiving the divided voltage and a first predetermined reference voltage and a second predetermined reference voltage to provide at least one comparison result, wherein the comparing unit comprises:

a first comparator, having a first input terminal, a second input terminal and a first output terminal, the first input terminal receiving the divided voltage and the second input terminal receiving the first predetermined reference voltage; and a second comparator, having a third input terminal, a fourth input terminal and a second output terminal, the third input terminal receiving the second predetermined reference voltage and the fourth input terminal receiving the divided voltage;

a time counting unit, coupled to the voltage divider and providing a plurality of timing control signals at different time points according to the divided voltage; and a processing unit, coupled to the comparing unit and the time counting unit, and providing a voltage reference signal to the direct-current voltage converter according to the plurality of timing control signals and the comparison result, and accordingly, the direct-current voltage converter adjusting an output voltage relating to the gate driving circuit.

2. The voltage compensation circuit as claimed in claim 1, wherein the first predetermined reference voltage is less than the second predetermined reference voltage.

3. The voltage compensation circuit as claimed in claim 1, wherein the processing unit comprises:

a first D-type flip-flop, coupled to the first output terminal and the time counting unit to provide a first comparing signal; and a second D-type flip-flop, coupled to the second output terminal and the time counting unit to provide a second comparing unit.

4. The voltage compensation circuit as claimed in claim 3, wherein the time counting unit respectively provides a first timing control signal and a second timing control signal among the plurality of timing control signals to the first D-type flip-flop and the second D-type flip-flop.

5. The voltage compensation circuit as claimed in claim 3, wherein the processing unit further comprises:

a control logic circuit, receiving the first comparing signal and the second comparing signal, and accordingly, providing a first logic control signal and a second logic control signal;

an adder-subtracter, coupled to the control logic circuit;

a latch circuit, coupled to the adder-subtracter and the time counting unit to provide a digital signal; and a digital-to-analog converting circuit, coupled to the latch circuit and generating the voltage reference signal according to the digital signal;

wherein the adder-subtracter performs a calculation according to the first logic control signal, the second logic control signal and the digital signal.

6. The voltage compensation circuit as claimed in claim 5, wherein the latch circuit comprises a plurality of D-type flip-flops.

7. The voltage compensation circuit as claimed in claim 5, wherein the latch circuit generates the digital signal according to a third timing control signal among the plurality of timing control signals and an output signal of the adder-subtracter.

* * * * *